United States Patent [19]

Lonseth

[11] 4,175,281

[45] Nov. 20, 1979

[54] CEILING MOUNTED SUPPORT STRUCTURE

[75] Inventor: Wayne F. Lonseth, Austin, Tex.

[73] Assignee: Esquire, Inc., New York, N.Y.

[21] Appl. No.: 908,069

[22] Filed: Aug. 22, 1978

[51] Int. Cl.[2] ..... F21S 1/02; F21S 3/02; F21V 17/00; F21V 19/00; F21V 21/02; E04B 5/52; E05C 3/04

[52] U.S. Cl. ..... 362/148; 52/28; 248/320; 362/150; 362/365; 362/366; 362/367; 362/368; 362/370; 362/371; 362/374; 362/375; 362/404

[58] Field of Search ..... 52/28; 362/148, 149, 362/150, 404, 405, 406, 365, 366, 367, 368, 374, 375, 370, 371, 290, 292, 330; 248/320-322, 324, 339

[56] References Cited

U.S. PATENT DOCUMENTS

| | | | |
|---|---|---|---|
| 2,294,883 | 9/1942 | Anderson et al. | 362/367 |
| 2,640,149 | 5/1950 | Arenberg | 362/330 |
| 2,659,807 | 11/1953 | Wakefield | 362/150 |
| 3,018,083 | 1/1962 | Bobrick | 362/365 |
| 3,222,839 | 12/1965 | Philpot | 362/404 |
| 3,383,811 | 5/1968 | Ades | 362/150 |
| 3,545,145 | 12/1970 | Yousefpor | 362/150 |
| 3,668,998 | 6/1972 | Johnson et al. | 362/365 |
| 3,720,432 | 3/1973 | Chudler | 362/365 |

*Primary Examiner*—Benjamin R. Padgett
*Assistant Examiner*—T. S. Gron
*Attorney, Agent, or Firm*—Frank S. Vaden, III

[57] ABSTRACT

A ceiling mounted support structure for mounting light fixtures, louvers, and the like, including at least one support piece mounted or supported by at least one building ceiling support, the piece having an elongate slot therein in which an enlarged end of a flipper bar rotates. The flipper bar rotates upwardly to permit the fixture part to be supported to pass upwardly therepast and rotates downwardly to provide the in-place support for the fixture part.

9 Claims, 8 Drawing Figures

FIG. 1
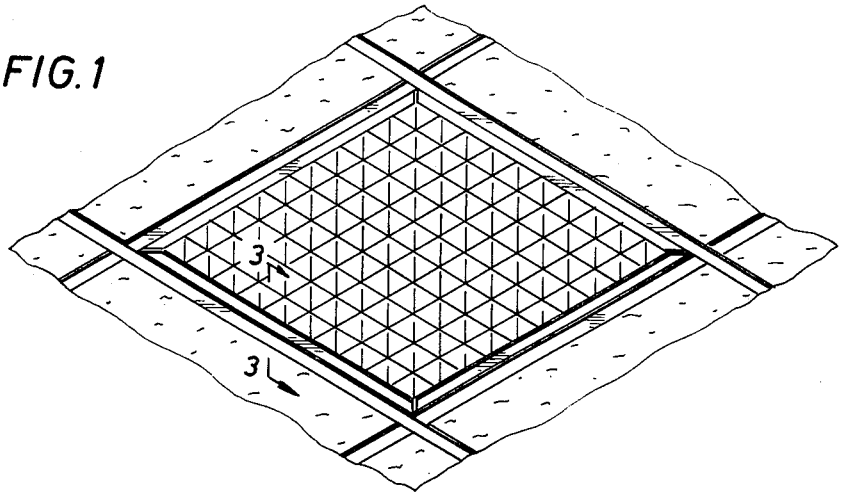
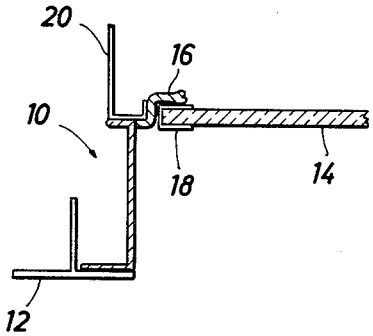
FIG. 2
(PRIOR ART)
FIG. 3
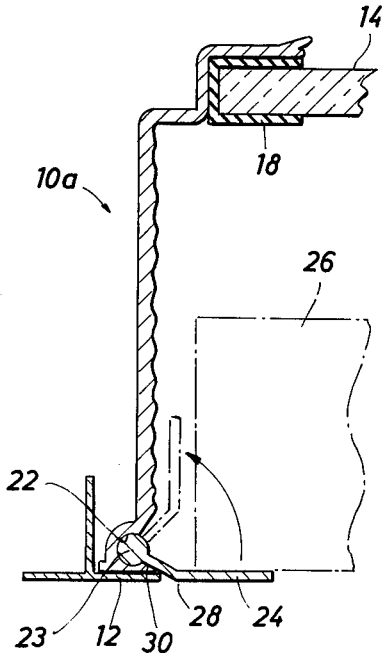
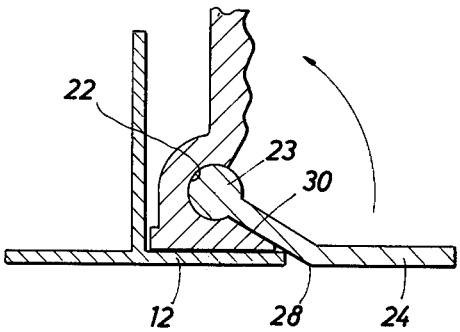
FIG. 4

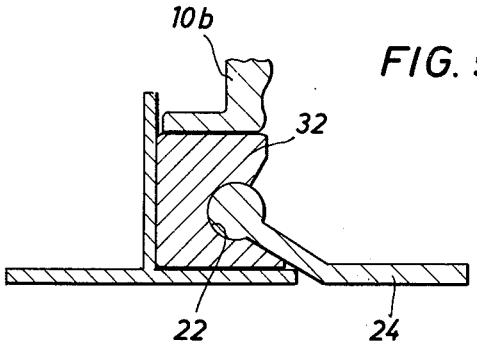
FIG. 5
FIG. 7
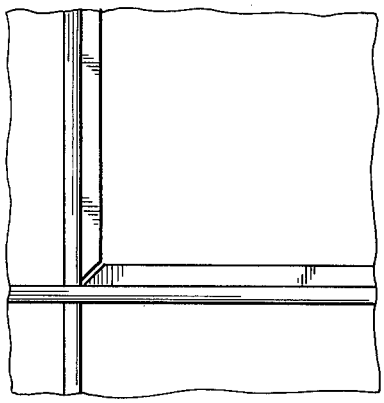
FIG. 6
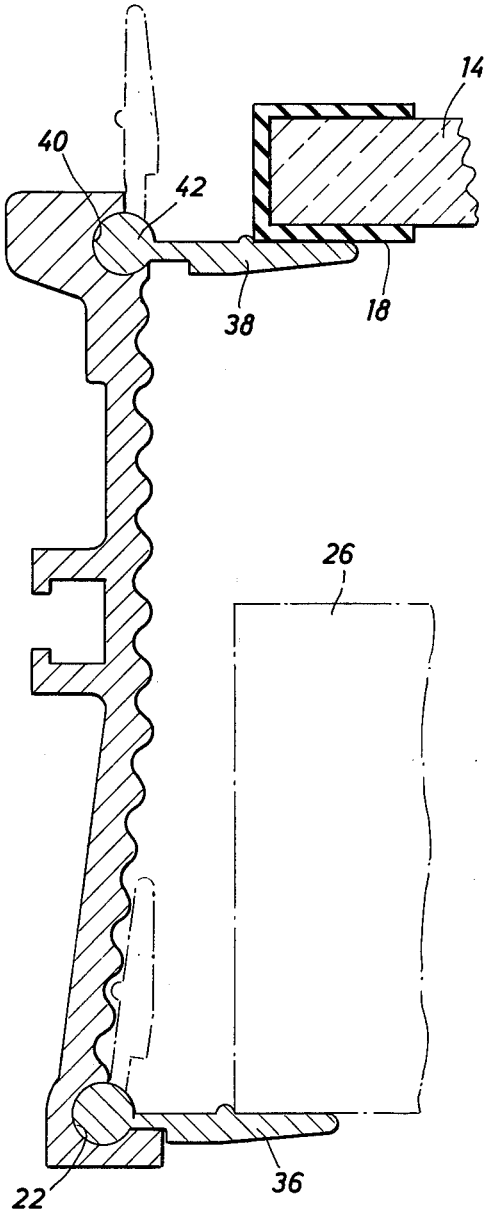
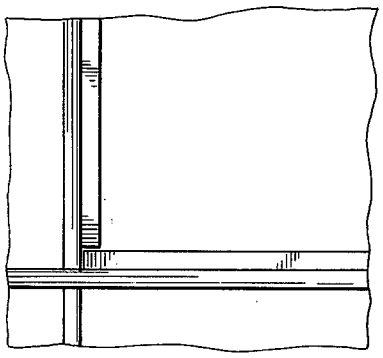
FIG. 8

CEILING MOUNTED SUPPORT STRUCTURE

BACKGROUND OF THE INVENTION

1. Field of the Invention

This invention pertains to ceiling mounted support structures for mounting of lighting fixtures and related components and more specifically to such structures for accepting various configurations with maximum installation ease.

2. Description of the Prior Art

Ceiling mounted lighting fixtures are often bolted or otherwise fixedly mounted in place in more or less permanent fashion. To replace the lens (covering over the bulb through which light emanates from the fixture, and which may or may not include light diffusing properties) or to replace a louver or grating which is an integral part of many installations requires often difficult and time-consuming effort on the part of the installer.

Attempts have been made in the prior art to develop schemes for easing installation burdens. One common type of fixture includes a fixed lower lip at the window opening of the reflector into which the pane of glass or plastic forming the lens can be turned and adjusted into place. The disadvantages of such a structure are: (1) the "slop" fit required to allow the turning and positioning often means that support for the lens in place is very tenuous allowing possible falling of the lens from the fixture in the presence of motor vibration or other building noises; and, (2) such a lip arrangement around a four-sided opening usually leaves an unsatisfactory gap along at least one side.

A prior art structure overcoming the difficulties in the prior art just recited is illustrated in U.S. Pat. No. 3,545,145, Yousefpor, wherein the fixture includes supporting clips rotationally mounted to permit the raising of the fixture vertically through a ceiling opening past the T-bars or other building supports while the clips are rotated downwardly or within the horizontal limits of the fixture. The clips are then rotated horizontally outwardly beyond the limits of the fixture so that when the fixture is lowered, the clips rest on the building supports and bear the weight of the fixture. Removal of the fixture is accomplished by reversing the procedure, namely, by lifting the fixture upward to permit the clips to rotate downwardly so as to again permit the fixture to be lowered from the opening.

U.S. Pat. No. 2,070,150, Venzie, of record in the Yousefpor patent, shows a rotating T-shaped clip as part of a ceiling-suspended structure. U.S. Pat. No. 3,383,811, Ades, also of record in the Yousefpor patent, includes a rotating piece of irregular shape to permit hanging of a suspended structure. Finally, Swedish Pat. No. 187,131 shows the suspension of a straight piece, such as a lens for light fixture would be, using removable supports insertable into special receiving slots of the building structure.

A feature of the present invention is to provide an improved universal support mechanism independent of a light fixture or similarly ceiling-installed apparatus to permit the installation of a light fixture, a lens assembly therefor, or a lower covering or the like with a maximum of ease and convenience.

Another feature of the present invention is to provide an improved universal support mechanism independent of a light fixture or similarly ceiling-installed apparatus to permit the installation of a light fixture, a lens assembly therefor, a louver therefor, or a cover therefor, or a plurality thereof, at different vertical positions, all without requiring special tools to accomplish the installation.

SUMMARY OF THE INVENTION

In a preferred embodiment of the present invention a frame is installed around the ceiling opening into which the fixture is to be mounted, typically supported at least on two sides by the top faces of T-bars forming the structural support for the ceiling tile. Each side of the frame is slotted toward the opening to rotationally receive a flipper bar support bar. In operation the bar is pushed upward from the bottom by the installer; the fixture, lens, louver or other structure is raised past the bar and then lowered back into a position of rest on the bar as it rotates downwardly to a stop position. The bar is preferably bent to permit full vertical positioning with minimum slot rotation and to permit horizontal positioning thereof so that the supported apparatus may be generally flushedly mounted, if desired.

The same arrangement can be provided at a vertical position other than flush with the ceiling to permit recess mounting or two such arrangements can be provided to permit the mounting of two structures, one vertically located above the other.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the drawings, which drawings form a part of this specification. It is to be noted, however, that the appended drawings illustrate only typical embodiments of the invention and are therefor not to be considered limiting of its scope, for the invention may admit to other equally effective embodiments.

In the drawings:

FIG. 1 is an oblique view from the bottom of a louver flushedly mounted onto a ceiling in accordance with the present invention.

FIG. 2 is a sectional view of a prior art structure provided for recessively mounting a light fixture, but not providing means for mounting a louver or other diffusing element in front of the lens.

FIG. 3 is a sectional view of a portion of a preferred support structure in accordance with the present invention suitable for accommodating a diffusing element in front of the lens of a recessed light fixture.

FIG. 4 is a close-up view of the mounting part of the structure shown in FIG. 3.

FIG. 5 is a cross-sectional view of an alternate structure to that shown in FIG. 4.

FIG. 6 is an alternate structure of a mounting apparatus suitable for replaceably mounting a recessed light fixture and a louver or other diffusing element in front thereof.

FIG. 7 is a partial plan view showing a preferred embodiment of the invention utilizing mitered corners on the support portion of the mounting apparatus.

FIG. 8 is a partial plan view of an alternate structure to that shown in FIG. 4 showing the use of support structures without mitered corners.

DESCRIPTION OF ILLUSTRATED EMBODIMENT

Now referring to the drawings, and first to FIG. 1, an oblique view of a supported, ceiling-mounted louver, frosted lens or other diffusing element in accordance with the present invention, is illustrated, the element being substantially flushedly mounted in the plane with the adjacent ceiling tiles. It is not uncommon to have light fixtures with an integral lens or other diffusing element therein permanently fixed or installed within the light fixture so that no accommodation is made for replacing the lens or adding an additional diffusing element in front thereof, such as with the invention herein described. For example, FIG. 2 illustrates a prior art frame or support piece 10 which is supported on the upper face of the building construction elements, typically T-bars 12, which elements also provide the structural support for the ceiling tiles at locations other than at light fixture openings, ventilation openings, and the like. Frame 10 is attached to fixture lens holder 16 in any convenient manner and may be actually a part thereof. Lens holder 16, in turn, is connected to grommet 18 through clamping means, slotted means or the like so as to hold the edges of lens 14 in fixed relationship to its fixture 20 at a recessed location from the ceiling. Note that there is not provision for either replacing lens 14 or for the installation of a louver, frosted lens or other diffusing element in front of lens 14, such as flush with the ceiling, as desirably shown in FIG. 1.

FIG. 3, on the other hand, shows such an arrangement in accordance with the present invention. Frame 10 in this arrangement is again supported on T-bar 12. However, at the lower extremity of frame **10*a* there is an elongate annular slot 22 opening toward the ceiling opening wherein the light fixture resides. At a recessed location, frame 10*a* holds grommet 18 which, in turn, holds the edges of lens 14 fixedly in place, all of which can be in the same manner as with the prior art structure shown in FIG. 2. However, at the lower extremity or location, flipper support bar 24 having an enlarged mating end 23 conforms and operates within slot 22 to provide the support for louver 26, which may also be a frosted lens or other diffusing element. Note further that flipper bar 24 also includes an oblique angle 28, which allows the support portion of flipper bar 24 to be approximately horizontal when the flipper bar is rotated to its support position or attitude, as illustrated in FIG. 3. Flipper bar 24 is limited in its downward rotation to its support position by shoulder 30, that portion of the frame depending from slot 22. In addition, the flipper bar may also rest on the edge of T-bar 12** when it is in its lower position. All of the above may be shown more clearly by the close-up view shown in FIG. 4.

Now referring to FIG. 5, an alternate structure to that shown in FIG. 4 is shown. In this case, frame **10*b* is separate from support piece 32 into which slot 22 is formed. Otherwise, the operation of flipper bar 24** is identical with the operation previously described for the structure shown in FIG. 4.

Now returning to FIG. 3, note that in operation flipper bar 24 is merely raised to its vertical position to permit the location of louver 26, which would be initially raised above the pivoted bar so that when the bar returns to its horizontal position louver 26 can be made to rest thereon. It should be further noted that the oblique angle 28 permits the pivot of louver 24 to the vertical position in such a manner that slot 22 may encompass approximately 270 degrees of the circumference. This holds enlarged end 23 within frame **10*a* (FIG. 4) or support piece 32** (FIG. 5).

Now referring to FIG. 6, a structure is illustrated having two flipper bar arrangements. In this structure, frame or support piece 34 is slotted at its lower end in a manner similar to that described for FIG. 3; however, in this case, support bar 36 does not include an oblique angle. Instead, it holds louver 26 at a slightly recessed position. It may be further noted from the arrangement shown in FIG. 7 for flipper bar 36 that the frame structure above slot 22 angles somewhat inwardly before continuing vertically upward therefrom. This is for an operational reason which is described hereinafter.

At a recessed or vertically displaced location where lens 14 is mounted, another flipper bar 38 is pivoted in slot 40 in a second frame part by its enlarged end 42 in a manner similar to flipper bar 36. It may be seen that slot 40 encompasses more than 180 degrees of periphery of enlarged end 42.

During installation, both flipper bars 36 and 38 are raised to their vertical positions and lens 14 or, alternately, the fixture which includes lens 14, is lifted through the opening and past both flipper bars above the position of vertical rotation of flipper bar 38. Flipper bar 38 is then rotated downwardly to the position illustrated in FIG. 6 and lens 14, or the fixture including lens 14, is allowed to rest thereon via grommet 18 in the position illustrated.

Louver 26 is next lifted upwardly past the vertical rotated position of bar 36 and bar 36 is rotated downwardly in the position shown in FIG. 6 to provide final position support. Louver 26 is then permitted to rest on bar 36 in the manner illustrated.

It may be seen that the inward angle of support piece 34 provides fairly close accommodation of lens 14 and so as to permit an outward diameter dimension of louver 26 which is approximately the same as the fixture structure.

The slotted structure on the frame 34 away from the accommodating ceiling fixture opening provides a tie-back structure for mounting support piece 34.

Nubs may be provided on the top surfaces of bars 36 and 38 to more accurately and steadily position lens 14 and louver 26, respectively, with respect to bars 38 and 36.

FIG. 7 and FIG. 8 illustrate two alternate methods of corner structure for flipper bar 24 or 36, previously described. FIG. 7 shows the mitering of the corners thereof, which provides a more universal, and generally aesthetically acceptable, appearance. However, corners of the support flipper bars may be at right angles provided they are made non-interfering, such as the structure shown in FIG. 8.

It may also be apparent that the edges of the louvers or other diffusing element being supported may be irregular, may not be uniformly dimensioned or may otherwise be of non-uniform appearance and still be acceptably and conveniently mounted in the manner just described without special treatment or special installation procedure. So long as the dimensions are within generally acceptable ranges or tolerances, the final installation is just as easy and the final appearance is just as acceptable as if all the edges were exactly true with one another, uniformly smooth, and the dimensions were within close tolerances.

While particular embodiments of the invention have been shown, it will be understood that the invention is not limited thereto, since many modifications may be made, such as flipper bars of different configurations and at multiple locations. For example, it would be readily possible to provide three locations of flipper bars to support three structures in the manner described for FIG. 6 for supporting two structures. Other modifications also may be made and will become apparent to those skilled in the art.

What is claimed is:

1. Support apparatus for ceiling mounting at least a portion of a light fixture located within a ceiling opening at least partially surrounded by a building structure presenting a lip toward the opening, comprising a frame piece for resting on the lip of the building structure and having an elongate slot therein open on the side thereof toward the ceiling opening, and an elongate flipper bar having one edge operating within said slot, the edge of the slot limiting movement of said flipper bar to a support position for providing support for at least a portion of the fixture.

2. Support apparatus in accordance with claim 1, wherein said elongate slot is annular and wherein said mating end of said flipper bar rotates therein and conforms to said slot throughout the limits of its rotation.

3. Support apparatus in accordance with claim 2, wherein said elongate slot encompasses more than 180 degrees of circumference of said mating end.

4. Support apparatus in accordance with claim 1, wherein said flipper bar includes an oblique angle to permit the end thereof operating within said frame slot to be located above the building structure lip on which said frame piece rests so as to permit a supporting portion of said flipper bar to be in a lower attitude.

5. Support apparatus in accordance with claim 4, wherein said supporting portion of said flipper bar is in an attitude substantially flush with the ceiling when in its support position.

6. Support apparatus in accordance with claim 1, and including a second frame piece at a vertically different position from said first named frame piece, said second frame piece having an elongate piece having an elongate slot therein open on the side thereof toward the ceiling opening, and a second elongate flipper bar having one edge operating within the slot of said second frame piece, the edge of such slot limiting movement of said second flipper bar to a support position for providing support for a different portion of the fixture than that supported by said first named flipper bar.

7. Support apparatus in accordance with claim 1, and including another frame piece adjacent said first named frame piece and at an angle therewith, said another frame piece having an elongate slot therein open on the side thereof toward the ceiling opening, and another elongate flipper bar having one end operating within the slot of said another frame piece, the edge of such slot limiting movement of said another flipper bar to a support position for providing support for the portion of the fixture also supported by said first named flipper bar.

8. Support apparatus in accordance with claim 7, wherein the adjacent corners of said first named flipper bar and said another flipper bar are mitered so as to avoid interference between said flipper bars when in their respective support positions.

9. Support apparatus in accordance with claim 1, wherein support is provided in a manner such that the light fixture rests on said flipper bar.

* * * * *